US009149102B2

(12) United States Patent
Fereyre et al.

(10) Patent No.: US 9,149,102 B2
(45) Date of Patent: Oct. 6, 2015

(54) STEAM HAIRDRESSING APPLIANCE EQUIPPED WITH A REMOTE CONTROL CIRCUIT BOARD

(71) Applicant: SEB S.A., Ecully (FR)

(72) Inventors: Regis Fereyre, Chavanay (FR); Serge Cubizolles, Oytier-Saint-Oblas (FR); Franck Mandica, Francheville (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 14/159,050

(22) Filed: Jan. 20, 2014

(65) Prior Publication Data

US 2014/0202487 A1 Jul. 24, 2014

(30) Foreign Application Priority Data

Jan. 18, 2013 (FR) ..... 13 50471

(51) Int. Cl.

| | |
|---|---|
| ***A45D 6/06*** | (2006.01) |
| ***A45D 1/04*** | (2006.01) |
| ***A45D 2/36*** | (2006.01) |
| ***A45D 4/00*** | (2006.01) |

(Continued)

(52) U.S. Cl.

CPC .. *A45D 2/00* (2013.01); *A45D 1/04* (2013.01); *A45D 2/001* (2013.01); *A45D 2001/008* (2013.01)

(58) Field of Classification Search

CPC ..... A45D 2/00; A45D 2/001; A45D 4/04; A45D 4/06; A45D 4/10; A45D 4/12; A45D 1/04; A45D 1/06; A45D 1/28; A45D 20/08; A45D 20/10; A45D 20/12; A45D 20/30; A45D 20/48; A45D 20/50; A45D 20/52; A45D 20/525; A45D 2001/008; A45D 2001/002; G05B 19/0421

USPC ..... 132/228, 210, 211, 212, 223–227, 132/229–235, 268, 269, 271, 272, 112, 132/113; 34/283, 511, 568, 96, 97, 101; 219/222, 225, 227, 229; 126/408; 392/324, 383–386; 700/282, 300, 3; 710/110

See application file for complete search history.

(56) References Cited

U.S. PATENT DOCUMENTS

| | | | | |
|---|---|---|---|---|
| 1,847,619 | A * | 3/1932 | Mascolo | 604/23 |
| 4,114,022 | A * | 9/1978 | Braulke, III | 392/383 |

(Continued)

FOREIGN PATENT DOCUMENTS

| | | | |
|---|---|---|---|
| EP | 2449911 | A1 | 5/2012 |
| FR | 2967017 | A1 | 5/2012 |
| GB | 2508590 | A * | 6/2014 |

*Primary Examiner* — Vanitha Elgart
(74) *Attorney, Agent, or Firm* — The Webb Law Firm

(57) ABSTRACT

Provided is a hairdressing appliance, which includes a portable treatment unit provided with a gripping device and a heat and steam treatment system configured for heating hair and for applying steam to this hair, a base remote from the portable treatment unit, and connection device between the base and the portable treatment unit configured for supplying the portable treatment unit at least with electricity from the base. The hairdressing appliance includes a circuit board for controlling the treatment system arranged in the base and a system of communication between the control circuit board and the treatment system. The hairdressing appliance enables, for example, the straightening, curling, or crimping of hair and chiefly aims to reduce the weight and the bulk of the portable treatment unit so as to make it easier to handle during styling.

11 Claims, 2 Drawing Sheets

(51) Int. Cl.
*A45D 1/00* (2006.01)
*A45D 2/00* (2006.01)

(56) References Cited

U.S. PATENT DOCUMENTS

| | | | | | |
|---|---|---|---|---|---|
| 4,418,333 | A * | 11/1983 | Schwarzbach et al. | ..... | 340/4.3 |
| 5,010,905 | A * | 4/1991 | Snyder et al. | ..... | 132/272 |
| 5,270,520 | A * | 12/1993 | Barzilai et al. | ..... | 219/501 |
| 5,584,307 | A * | 12/1996 | Bauer et al. | ..... | 132/113 |
| 5,715,360 | A * | 2/1998 | Montagnino | ..... | 392/403 |
| 6,584,985 | B2 * | 7/2003 | Omura | ..... | 132/272 |
| 2005/0061352 | A1 * | 3/2005 | Yao | ..... | 132/225 |
| 2005/0150512 | A1 * | 7/2005 | Park | ..... | 132/228 |
| 2007/0000512 | A1 * | 1/2007 | Park | ..... | 132/224 |
| 2008/0087295 | A1 * | 4/2008 | Park | ..... | 132/232 |
| 2009/0159093 | A1 * | 6/2009 | Yu | ..... | 132/211 |
| 2010/0180908 | A1 * | 7/2010 | Leung | ..... | 132/223 |
| 2010/0242986 | A1 * | 9/2010 | Serresvives et al. | ..... | 132/227 |
| 2010/0288298 | A1 * | 11/2010 | Serresvives et al. | ..... | 132/272 |
| 2011/0108053 | A1 * | 5/2011 | Yahnker et al. | ..... | 132/269 |
| 2011/0253164 | A1 * | 10/2011 | Morgandi et al. | ..... | 132/211 |
| 2012/0111355 | A1 * | 5/2012 | Vacheron et al. | ..... | 132/228 |
| 2012/0111356 | A1 | 5/2012 | Vacheron et al. | | |
| 2012/0291797 | A1 * | 11/2012 | deGrood et al. | ..... | 132/211 |
| 2012/0312320 | A1 * | 12/2012 | Humphreys et al. | ..... | 132/211 |

* cited by examiner

STEAM HAIRDRESSING APPLIANCE EQUIPPED WITH A REMOTE CONTROL CIRCUIT BOARD

CROSS REFERENCE TO RELATED APPLICATIONS

This application claims priority to French Application No. 1350471 filed Jan. 18, 2013, the disclosure of which is hereby incorporated in its entirety by reference.

FIELD OF THE INVENTION

The present invention relates to a steam hairdressing appliance intended for treating hair with heat and steam for styling the same. Depending upon its design, such a hairdressing appliance can be used for straightening, curling, or crimping hair.

BACKGROUND OF THE INVENTION

Hairdressing appliances for straightening, curling, or crimping hair typically comprise a portable treatment unit composed in particular of two arms, or jaws, which each have a surface that can be flat or curved, the two arms being hinge-connected to one another to form a clamp configured for clamping hair between the two surfaces facing one another as the two arms are brought together. These two arms also comprise a gripping zone enabling the opening and closing of the clamp and the handling thereof during the styling. At least one of these two surfaces has a heating device enabling the treatment of hair with heat while it is clamped between the two surfaces. The straightening of a lock of hair is effected by clamping the lock of hair between the two surfaces and by moving the closed clamp along this lock of hair, from the root to the tip. The curling of a lock of hair is effected by clamping the lock of hair between the two surfaces and by winding, at least partially, this lock of hair around the surfaces, the heat making it possible to set the curl. For improving the hair styling, it is possible to use a steam treatment as a supplement to the heat treatment, said steam being applied to the hair.

To this end, the Applicant has already developed a steam hairdressing appliance, which is described in the patent application published under the number FR 2 967 017 A1. Besides the aforementioned technical features, the hairdressing appliance according to FR 2 967 017 A1 comprises a base remote from the portable treatment unit, said portable treatment unit composed of a clamp as described above. The base comprises a water tank and a water pump which, when turned on, pumps the water in the tank for supplying the clamp. One of the arms of the portable treatment unit comprises a vaporization chamber equipped with a heating device. Once the hairdressing appliance has attained its optimum operating conditions and when the user wishes to use steam for styling his/her hair, the pump injects water into the vaporization chamber; this water vaporizes under the action of the heating device, and the steam is then applied to the hair. Thus the clamp makes it possible to treat hair with heat and with steam. In the hairdressing appliance described in FR 2 967 017 A1, connection means between the base and the portable treatment unit make it possible to supply said treatment unit with electricity and water from the base. The portable treatment unit further comprises a circuit board for controlling the heat and steam treatment system and the pump, this control circuit board being located in the portable treatment unit.

SUMMARY OF THE INVENTION

Besides the advantages gained by the hairdressing appliance described in FR 2 967 017 A1, the present invention aims to optimize the ergonomics and to reduce the weight of the portable treatment unit of the hairdressing appliance, in this case the clamp, in order to make it easier to handle.

For this purpose, the invention relates to a hairdressing appliance that comprises a portable treatment unit provided with gripping means and a heat and steam treatment system configured for treating hair by heating it and applying steam thereto. The hairdressing appliance also comprises a base remote from the portable treatment unit. Similarly, the hairdressing appliance comprises connection means between the base and the portable treatment unit, which means are configured for supplying the portable treatment unit with at least electricity from the base. According to the invention, the hairdressing appliance comprises a circuit board for controlling the heat and steam treatment system, said control circuit board being arranged in the base. According to the invention, the hairdressing appliance further comprises a system of communication between the control circuit board and said treatment system. Moving the control circuit board to the base thus makes it possible to reduce the bulk of the portable treatment unit considerably, which reduces its weight and makes it easier to handle as well as to hold. Furthermore, the communication system simplifies the design of the connection means between the base and the treatment unit.

In an embodiment of the hairdressing appliance of the invention, the appliance comprises a fluid or water tank and a motorized water flow regulation system, and the control circuit board is configured for controlling said motorized water flow regulation system. The flow regulation system allows the formation and the flow of steam applied by the appliance to be controlled.

In a preferred embodiment of the hairdressing appliance of the invention, the base is provided with a fluid or water tank and a motorized system for regulating the flow of the water or fluid, preferably a system for pumping the water in the tank. The water flow regulation system comprises means for driving a member for conveying water or fluid into the vaporization chamber. The latter can be a pump, for example an electric pump such as a peristaltic pump, and the drive means can comprise a motor. In a non-limiting example, it can be a motor for actuating the displacement of the roller or rollers of a peristaltic pump. Furthermore, the connection means are configured for supplying the portable treatment unit with water from the base and the control circuit board is configured for controlling the motorized water flow regulation system, for example the pump, preferably the electric pump. This design also helps in considerably reducing the bulk of the portable treatment unit. However, other means for supplying water to the heat and steam treatment system for generating said steam are also conceivable. For example, these water supplying means can be composed of a water-soaked foam housed in a compartment on the treatment system, which comprises actuating means configured for displacing the water-soaked foam on a heating element of said treatment system so as to generate steam.

In a preferred embodiment of the hairdressing appliance of the invention, the circuit board for controlling the treatment system and the pump is a master or mother circuit board, meaning that the latter manages and transmits treatment data to the heat and steam treatment system and receives information from the portable treatment unit. Additionally, the communication system comprises a slave circuit board, meaning that the latter receives the data from the master circuit board for activating the heat and steam treatment system and that it in turn transmits information on the state of the treatment unit to the master circuit board. This slave circuit board is arranged on the portable treatment unit. The communication system further comprises first electric wires connected between the master circuit board and the slave circuit board and second electric wires connected between the slave circuit board and the treatment system. It is understood that the slave circuit board is considerably less bulky than the master circuit board, thus making it possible to reduce the size of the portable treatment unit. Furthermore, this design has the benefit of limiting the number of electric wires present in the connecting means. Indeed, in a variant of embodiment of the invention it is conceivable to move all of the electronics for controlling the heat and steam treatment system and the pump to the base, and to activate the heat and steam treatment system directly from this base. This would have the advantage of reducing the size of the portable treatment unit, but the drawback of increasing the number of electric wires needed for activating the heat and steam treatment system and receiving information from said treatment system. According to the invention, provision could also be made of variants of embodiment such as, for example, a radio frequency emission and reception communication system arranged between the master circuit board in the base and the slave circuit board in the portable treatment unit.

According to this preferred embodiment of the hairdressing appliance of the invention, the first electric wires are at least three in number. In variants of embodiment, these first electric wires may be three, four, or five in number, or even in some other number, in particular if a radio frequency emission and reception communication system is arranged between the master circuit board in the base and the slave circuit board in the portable treatment unit.

According to this preferred embodiment of the hairdressing appliance of the invention, the heat and steam treatment system comprises at least three heating devices and three devices for measuring the temperature of these heating devices, and the second electric wires are at least six in number and connected, respectively, between said devices and the slave circuit board. However, a variant of embodiment with only two heating devices and two devices for measuring the temperature of said heating devices, or even one measuring device, and at least four second electric wires is conceivable without going beyond the scope of the invention.

According to this preferred embodiment of the hairdressing appliance of the invention, the heating devices are positive temperature coefficient thermistors and the measuring devices are negative temperature coefficient thermistors.

In an embodiment of the hairdressing appliance of the invention, the latter is a straightener. The portable treatment unit of this straightener comprises two arms, each provided with a heating surface equipped with a heating device, said arms forming a clamp configured for clamping hair between the two heating surfaces, one of the arms comprising a vaporization chamber equipped with a third heating device.

According to this embodiment of the hairdressing appliance of the invention, the portable treatment unit comprises a device for the detection of the positions "clamp open" and "clamp closed", and at least two electric wires are connected between said detection device and the slave circuit board.

According to the hairdressing appliance of the invention, the latter comprises a starter and temperature control device arranged on the base. This also limits the bulk of the portable treatment unit.

According to the hairdressing appliance of the invention, the latter comprises a connection system arranged on the base and configured for connecting the circuit board for controlling the treatment system and the motorized water flow regulation system to an external interface for setting parameters. It is thus possible to modify the settings of the treatment system such as the heating time over a given period, the temperature of the heating device for steam generation, etc.

According to the hairdressing appliance of the invention, the motorized water flow control system is an electric pump.

BRIEF DESCRIPTION OF THE DRAWINGS

The following description reveals the features and advantages of the hairdressing appliance of the present invention. This description refers to figures, in which.

DESCRIPTION OF THE INVENTION

Between the two embodiments, the same reference signs are identical when the features are the same.

Figure 1:
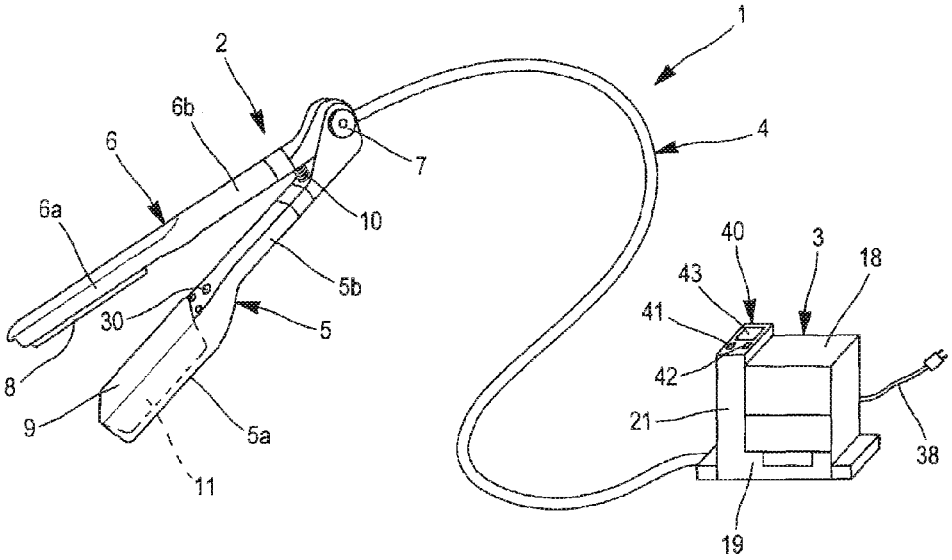
FIG. 1 shows an overall view of a first embodiment of the hairdressing appliance of the invention, composed of a straightener.

In FIG. 1, the hairdressing appliance 1 of the invention is a hair straightener. The latter comprises a portable treatment unit 2, a base 3 remote from the portable treatment unit 2 and connected to this portable treatment unit 2 by means of a connection cable 4 configured for supplying said portable treatment unit 2 with water and electricity from the base 3. The portable treatment unit 2 comprises two arms 5, 6 (also known as jaws) hinge-connected to one another by means of a pivot linkage 7, thus constituting a clamp.

Figure 3:
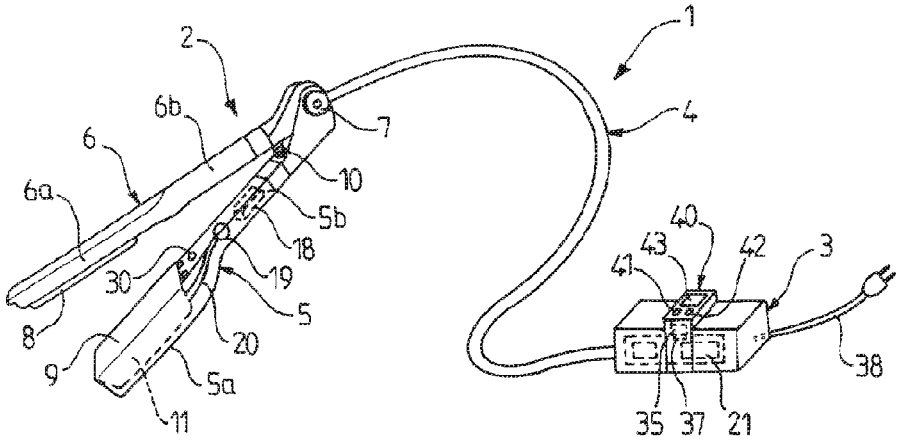
FIG. 3 shows an overall view of a second embodiment of the hairdressing appliance of the invention, composed of a straightener.

In FIG. 3, the straightener comprises a portable treatment unit 2, a base 3 remote from the portable treatment unit 2 and connected to this portable treatment unit 2 by means of a connection cable 4 configured for supplying said portable treatment unit 2 with electricity from the base 3. Water or fluid is supplied from the portable treatment unit 2. The two arms 5, 6 each comprise, on their inside face and in their distal portion 5*a*, 6*a*, a heating surface 8, 9. According to the embodiment of FIG. 1, the heating surfaces are flat and in the shape of two plates. Obviously variants with curved heating surfaces as in hairdressing appliances of the curler type, or even undulated heating surfaces as in hairdressing appliances of the crimping type, are also conceivable. Variants of embodiment with only one of the two surfaces being a heating surface and with the other surface merely helping to clamp the lock of hair for styling the same are furthermore conceivable.

The two arms 5, 6 each comprise a proximal portion 5*b*, 6*b*. These two proximal portions 5*b*, 6*b* can be grasped simultaneously with one hand, thus making it possible to handle the portable treatment unit 2 and close the clamp when the two proximal portions 5*b*, 6*b* are clasped. When the clamp is closed, the heating surfaces 8, 9 facing one another come into contact with one another, thus clamping a lock of hair positioned between these two heating surfaces 8, 9.

A spring element 10 (illustrated in FIGS. 1 and 3) is arranged between the inside faces of the two arms 5, 6 near the pivot linkage 7 and operates by extension, thus allowing the clamp to open and the two heating surfaces 8, 9 to separate for releasing the lock of hair when the user's hand slightly relaxes the pressure on the two proximal portions 5*b*, 6*b*.

As shown in FIGS. 1 and 3, in its distal portion 5*a* the first arm 5 comprises a vaporization chamber 11 for generating steam and applying this steam to the lock of hair clamped between the two heating surfaces 8, 9 when the clamp is closed.

In an embodiment, the portable treatment unit 2 of the hairdressing appliance 1 of the invention can assume technical features similar to those described in French Patent Application No. 2 967 017 A1 filed by the Applicant in terms of the execution of the heating surfaces 8, 9 and the vaporization chamber 11, with all of the advantages that such a design gains. Obviously variants are still conceivable for these elements without going beyond the scope of the invention.

Figure 2:
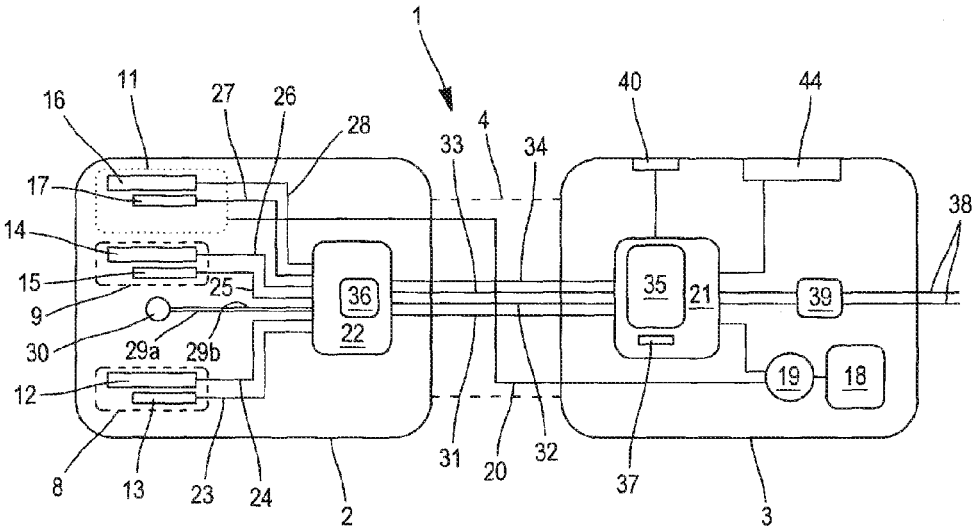
FIG. 2 schematically illustrates the components integrated in the hairdressing appliance according to the first embodiment of the invention.
Figure 4:
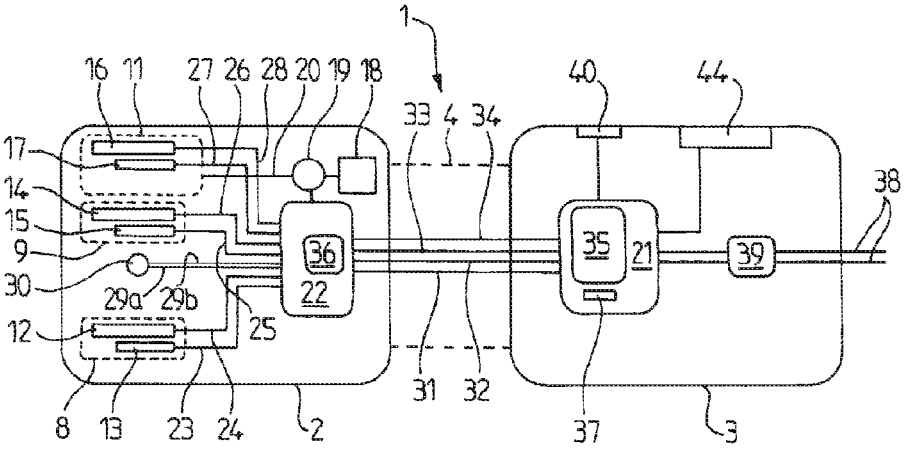
FIG. 4 schematically illustrates the components integrated in the hairdressing appliance according to the second embodiment of the invention.

To this end and as schematically illustrated in FIGS. 2 and 4, the first heating surface 8 comprises a heating device composed of a positive temperature coefficient (PTC) thermistor 12 and a device for measuring the temperature of the heating device composed of a negative temperature coefficient (NTC) thermistor 13. The second heating surface 9 likewise comprises a heating device composed of a positive temperature coefficient thermistor 14 and a device for measuring the temperature of the heating device composed of a negative temperature coefficient thermistor 15. The vaporization chamber 11 likewise comprises a heating device composed of a positive temperature coefficient thermistor 16 and a device for measuring the temperature of the heating device composed of a negative temperature coefficient thermistor 17. According to this embodiment, the heat and steam treatment system thus comprises three PTC and three NTC thermistors. In a variant of embodiment in which only one of the two surfaces is heating, the other surface merely helping to clamp the lock of hair for styling the same, said treatment system is understood to comprise only two positive temperature coefficient thermistors and two negative temperature coefficient thermistors, or even one negative temperature coefficient thermistor measuring the temperature of the two positive temperature coefficient thermistors in certain known variants.

As illustrated schematically in FIGS. 1 and 2, the base 3 comprises a water tank 18 and a pump 19 for dispensing water from the base 3 to the portable treatment unit 2 via the connection cable 4 with the aim of applying steam to the hair. To this end, the connection cable comprises a hose 20 connected between the pump 19 and the vaporization chamber 11.

Alternatively and as schematically illustrated in FIGS. 3 and 4, the portable treatment unit 2 comprises a water tank 18 and a fluid flow regulation system 19 (also called fluid flow regulation mechanism 19), for example a motorized fluid flow regulation system such as an electric pump for dispensing water into the vaporization chamber of the unit with the aim of applying steam to the hair. The connection cable then comprises electric wires but not does not have to comprise a fluid flow conduit. The treatment unit may be slightly larger in volume because it comprises a fluid tank. Nevertheless the base 3 is less bulky and constitutes a base with switch (in particular ON/OFF switch 41, operation mode control 42 switch, indicator dial 43) and screen controls for the user, this base being connected between the electric cable 4 and the electric wire directly linked to the connection socket 38 of the appliance 1. Because this base is less bulky, it can be attached to a mains power cable and held aloft during use without having to be placed on a work surface: this makes it possible to reduce the length of the power cable and the cost thereof, which is also achieved by the absence of a fluid flow conduit.

In an embodiment, the hairdressing appliance 1 of the invention can assume technical features similar to those described in French Patent Application No. 2 967 017 A1 filed by the Applicant in terms of the execution of the water tank 18 and the pump 19 connected to the vaporization chamber 11, with all of the advantages that such a design gains. Obviously variants are still conceivable without going beyond the scope of the invention.

Unlike the hairdressing appliance described in French Patent Application No. 2 967 017 A1, the hairdressing appliance 1 of the invention comprises a master circuit board 21 (also called a mother board), which is integrated in the base 3 as shown schematically in FIGS. 1-4. This master circuit board 21 is configured for controlling the activation of the two heating surfaces 8, 9, of the vaporization chamber 11 and of the motorized fluid flow regulation mechanism 19 in relation to the state of the portable treatment unit 2.

As illustrated in FIG. 2, the portable treatment unit 2 comprises a slave circuit board 22 arranged inside one of the two arms 5, 6, for example in the proximal portion 5*b* of the first arm 5, which is equipped with a greater number of electric components than the second arm 6, which limits the amount of electric wire used for connecting said electric components to the slave circuit board 22. To this end, and as shown schematically in FIG. 2, electric wires 23-28 are connected between the slave circuit board 22 and the positive 12, 14, 16 and negative 13, 15, 17 temperature coefficient thermistors. The number of electric wires is understood to depend on the number of positive temperature coefficient thermistors and negative temperature coefficient thermistors present in the treatment system.

As illustrated in FIGS. 1-4, two electric wires 29*a*, 29*b* are likewise connected between the slave circuit board 22 and a magnetic reed switch (FR: ILS) sensor 30, which enables the detection of the closed position of the clamp in which the two heating surfaces 8, 9 are brought together and clamp a lock of hair. In a variant, the reed switch could be replaced with a magneto-resistive (MRS) sensor, which would require three rather than two electric wires.

The master circuit board 21 is connected to the slave circuit board 22 by means of four electric wires 31-34. The master circuit board 21 comprises in particular a microprocessor 35, which is programmed to transmit data to a second microprocessor 36 comprising the slave circuit board 22, said data relating to the positive temperature coefficient thermistors 12, 14, 16 so as to control the temperature operation of the heating surfaces 8, 9 and of the vaporization chamber. The first microprocessor 35 also directly controls the operation of the motorized fluid flow regulation mechanism 19 for supplying the vaporization chamber 11 with water. Conversely, the first microprocessor 35 receives data from the second microprocessor 36, said data relating to the negative temperature coefficient thermistors 13, 15, 17 and to the magnetic sensor 30 so as to know the temperature operation state of the heating surfaces 8, 9 and of the vaporization chamber 11, as well as the open or closed position of the clamp composed of the two arms 5, 6. To this end, the two microprocessors 35, 36 are connected to one another by a first 31 of the electric wires.

The master circuit board 21 comprises a voltage transformer 37 shown schematically in FIG. 2 for supplying the first microprocessor 35 with 5 volts of voltage. This voltage transformer 37 also supplies the second microprocessor 36 on the slave circuit board 22. To this end, a second 32 of the electric wires is used to connect the voltage transformer 37 to the second microprocessor 36. In a variant of embodiment, however, provision could be made for the slave circuit board 22 itself to generate a voltage of 5 volts, in which case it would be possible to dispense with this second electric wire 32.

The base 3 is supplied by an outside power source (not shown) and for this purpose comprises a socket 38 for connecting to this outside power source. The master circuit board 21 is connected to this outside power source via the connection socket 38 and optionally by means of a second voltage transformer 39 allowing a reduction of the voltage to, for example, 5, 12, or 24 volts. The master circuit board 21 is connected to the slave circuit board 22 by the third 33 and the fourth 34 of the electric wires for supplying voltage to the positive temperature coefficient thermistors 12, 14, 16.

Hence on the one hand, the design according to the invention makes it possible to reduce the size of the portable treatment unit 2 because the slave circuit board 22 present in one of the arms 5, 6 is less bulky than the remote master circuit board 21 in the base 3. This makes the portable treatment unit 2 easier to handle and hold. On the other hand, this slave circuit board 22 limits the number of electric wires connecting the base 3 to the portable treatment unit 2 to four or even three. The connection cable 4 thus comprises the four electric wires 31-34 and the hose 20. The thickness of the connection cable 4 is thus reduced, also making it easier to handle the treatment unit 2.

In a variant of embodiment, a reduction of the size of the portable treatment unit 2 is achievable by moving all of the control electronics to the base 3. In this case it would be necessary to have at least five first electric wires for a connection to the heat and steam treatment system and to the detection device 30.

The slave circuit board 22 receives data from the negative temperature coefficient thermistors 13, 15, 17 relating to the temperature of the heating surfaces 8, 9 and to the temperature in the vaporization chamber 11 and data from the magnetic sensor 30 relating to the open or closed state of the clamp. The slave circuit board 22 then transmits these data to the master circuit board 21, which in turn transmits data to said slave circuit board 22 for supplying, or not, the positive temperature coefficient thermistors 12, 14, 16 depending upon the state of the portable treatment unit 2. A person skilled in the art thus understands that the master circuit board 21 is programmed to control the time and activation temperature parameters of said positive temperature coefficient thermistors 12, 14, 16. The master circuit board 21 is likewise programmed to control the activation time parameters of the motorized fluid flow regulation mechanism 19. With his/her technical expertise, a person skilled in the art is able to define different operation modes of the hairdressing appliance 1 and program the microprocessors 35, 36 accordingly.

As shown in FIGS. 1-4, a starter and temperature control device 40 is arranged on the base 3 and connected to the master circuit board 21. Said device comprises, for example, an ON/OFF switch 41 for turning the hairdressing appliance 1 on and an operating mode control switch 42 and a dial 43 indicating the operating state.

As shown schematically in FIGS. 2 and 4, the base 3 comprises a connection system 44 connected to the master circuit board 21. This connection system 44 makes it possible to connect the master circuit board 21 to an outside interface such as a computer and to access the program of the microprocessor 35 with the aim of enabling, for example, a modification of the cycle time and operating temperature parameters of the positive temperature coefficient thermistors 12, 14, 16 and the activation time of the motorized fluid flow regulator mechanism, e.g., the pump 19.

Other features are conceivable without going beyond the scope of the invention, particularly in terms of the design of the portable treatment unit 2 for making different hair styles possible, and also in terms of the execution of the base 3. For example, according to a variant of embodiment the water tank 18 and the pump 19 could be replaced with a compartment (not shown) on the portable treatment unit 2 for receiving a water-soaked foam and by actuation means for moving said foam against a heating element for generating steam. In this case the size of the portable treatment unit 2 would certainly be greater, but the size of the base 3 would be smaller, as would the thickness of the connection cable 4, which would no longer comprise the hose 20. The second embodiment illustrated in FIGS. 3 and 4 is similar to this variant.

The invention claimed is:

1. Hairdressing appliance comprising:

a portable treatment unit provided with gripping means and a heat and steam treatment system configured for heating hair and for applying steam to this hair, a base remote from the portable treatment unit, and connection means between the base and the portable treatment unit configured for supplying the portable treatment unit at least with electricity from the base, characterized in that the hairdressing appliance comprises a control circuit board for the heat and steam treatment system arranged in the base and a system of communication between the control circuit board and the treatment system, and wherein the control circuit board is a master circuit board and the communication system comprises a slave circuit board arranged on the portable treatment unit, first electric wires are connected between the master circuit board and the slave circuit board, and second electric wires are connected between the slave circuit board and the treatment system and wherein the master circuit board manages and transmits data to the slave circuit board and the slave circuit board receives the data and transmits information on the state of the heat and steam treatment system to the master circuit board.

2. Hairdressing appliance as in claim 1, comprising a water or fluid tank and a motorized water flow regulation system, the control circuit board being configured for controlling said motorized water flow regulation system.

3. Hairdressing appliance as in claim 2, in which the base is equipped with the water tank and the motorized water flow regulation system, the connection means being configured for supplying the portable treatment unit with water from said base, the control circuit board being configured for controlling said motorized water flow regulation system.

4. Hairdressing appliance as in claim 1, in which the first electric wires are at least three in number.

5. Hairdressing appliance as in claim 1, in which the treatment system comprises at least two heating devices and at least one device for measuring the temperature of the heating devices, and the second electric wires are at least four in number and connected, respectively, between said devices and the slave circuit board.

6. Hairdressing appliance as in claim 5, in which the heating devices are positive temperature coefficient thermistors and the measurement devices are negative temperature coefficient thermistors.

7. Hairdressing appliance as in claim 5, which is a straightener in which the portable treatment unit comprises two arms, each of which is provided with a heating surface equipped with a heating device, said arms forming a clamp configured for clamping hair between the two heating surfaces, one of the arms comprising a vaporization chamber equipped with a third heating device.

8. Hairdressing appliance as in claim 7, in which the portable treatment unit comprises a device for detecting the positions "clamp open" and "clamp closed", and at least two electric wires are connected between said detection device and the slave circuit board.

9. Hairdressing appliance as in claim 7, which comprises a starter and temperature control device arranged on the base.

10. Hairdressing appliance as in claim 2, which comprises a connection system arranged on the base and configured for connecting the control circuit board of the treatment system and of the motorized water flow regulation system to an outside interface for setting parameters.

11. Hairdressing appliance as in claim 2, wherein the motorized water flow regulation system is an electric pump.

* * * * *